US008567312B2

(12) United States Patent
Hofman et al.

(10) Patent No.: US 8,567,312 B2
(45) Date of Patent: Oct. 29, 2013

(54) BULK BAG CONDITIONING SYSTEM

(75) Inventors: Thomas J. Hofman, Holland, MI (US); Scott L. Nyhof, Hamilton, MI (US)

(73) Assignee: Material Transfer & Storage, Inc., Allegan, MI (US)

( * ) Notice: Subject to any disclaimer, the term of this patent is extended or adjusted under 35 U.S.C. 154(b) by 0 days.

(21) Appl. No.: 13/476,994

(22) Filed: May 21, 2012

(65) Prior Publication Data

US 2012/0227594 A1 Sep. 13, 2012

Related U.S. Application Data

(63) Continuation of application No. 12/393,783, filed on Feb. 26, 2009, now Pat. No. 8,181,568.

(60) Provisional application No. 61/032,811, filed on Feb. 29, 2008.

(51) Int. Cl.
*B30B 13/00* (2006.01)
*B30B 7/04* (2006.01)

(52) U.S. Cl.
USPC ..... 100/35; 100/233; 100/264

(58) Field of Classification Search
USPC ..... 100/35, 122, 123, 233, 264, 269.01; 222/103, 105, 202, 203; 414/415; 366/243, 276; 141/73, 77
See application file for complete search history.

(56) References Cited

U.S. PATENT DOCUMENTS

| | | | | |
|---|---|---|---|---|
| 1,649,362 | A * | 11/1927 | Nagel | 141/12 |
| 4,140,052 | A * | 2/1979 | Meier | 100/233 |
| 5,699,730 | A * | 12/1997 | Ogier et al. | 100/233 |
| 5,788,449 | A * | 8/1998 | Riemersma | 414/415 |
| 6,312,151 | B1 * | 11/2001 | Pendleton | 366/332 |
| 7,223,058 | B2 * | 5/2007 | Nyhof | 414/415 |
| 8,181,568 | B1 * | 5/2012 | Hofman et al. | 100/35 |
| 2003/0024421 | A1 * | 2/2003 | Braune et al. | 100/348 |

* cited by examiner

*Primary Examiner* — Jimmy T Nguyen
(74) *Attorney, Agent, or Firm* — The Watson I.P. Group, PLC; Jovan N. Jovanovic; Vladan M. Vasiljevic

(57) ABSTRACT

A Bulk Bag Material Conditioning System that includes a main conditioner frame and a plurality of bulk bag conditioner assemblies engaged to the upper portion of the main conditioner frame where the bulk bag conditioner assemblies travel a non-linear path, typically on an arcuous path from a bulk bag disengaged position to a bulk bag engaging position.

15 Claims, 7 Drawing Sheets

BULK BAG CONDITIONING SYSTEM

CROSS REFERENCE TO RELATED APPLICATION

This application is a continuation of U.S. patent application Ser. No. 12/393,783 filed Feb. 26, 2009, entitled Bulk Bag Conditioning System, now U.S. Pat. No. 8,181,568, which claims priority from U.S. Prov. Pat. App. Ser. No. 61/032,811 filed Feb. 29, 2008 entitled Bulk Bag Conditioning System, the entire disclosure of each of the foregoing is incorporated by reference herein in their entirety.

BRIEF SUMMARY OF THE INVENTION

According to an embodiment of the present invention, a bulk bag material conditioner system includes a main conditioner frame and bulk bag pivoting conditioning assemblies, preferably two bulk bag conditioner assemblies. The bulk bag material conditioner also typically includes a safety system and lift assembly.

The bulk bag pivoting conditioning assemblies are typically hydraulically driven and fixably mounted to the cross supports of the main conditioner frame such that when the hydraulic cylinder is activated to actuate the bulk bag pivoting conditioning assemblies the bulk bag pivoting conditioning assemblies pivot about a fixed point where they are attached to the cross supports of the main conditioner frame and rotate upward in an arcuous/curvilinear manner until an amount of pressure, typically an (adjustable) predetermined amount of pressure is supplied on the bulk bag and/or until the assemblies have traveled a predetermined distance. The appropriate amount of pressure supplied to both sides of the bulk bag can be determined or predetermined based on the material to be conditioned in the bulk bag. Typically, the assembly contacts the bag at different predetermined heights on opposite sides of the bulk bag.

The lift assembly elevates or lowers (when appropriate) the bulk bag when the bulk bag contacting pivoting conditioning assemblies are disengaged from the bulk bag. Thereafter, the bulk bag pivoting conditioning assemblies are then activated and actuated to contact a different location on the opposing sides of a bulk bag. Another embodiment of the present invention incorporates a manual or powered rotary turntable as an element of the lift assembly or place on the lift. The bulk bag is placed on the rotary turntable prior to conditioning. When in use, this allows the conditioner to contact any surface of the bulk bag. Typically the bulk bag is conditioned on two opposing surfaces, the rotary turntable rotates the bag 90° and the opposite surfaces are conditioned (again at any number of predetermined heights and locations along the bag, but typically within the range of 1 to 12 different heights and/or locations (more typically between one to three different heights and/or locations) along the height of the outer surface of the bulk bag). The bulk bag pivoting conditioning assemblies of the present invention allow for a significantly decreased footprint on a work floor. Typically, the footprint of the bulk bag material conditioners of the present invention have dimension of about 115 inches wide from the edge of one cylinder guard to the other (these elements project wider than the feet of the assembly by about 12-13 inches); a height of about 102 inches and a depth of about 72 inches. Additionally, in contrast to known bulk bag conditioners that utilize compacting frames that apply opposing forces directly opposite one another in a linear or substantially linear fashion, the bulk bag material assembly of the present invention does not apply substantial downward force on the assembly via the material in the bag when the conditioners are engaged, but instead force the material upward in the bag while conditioning the material due to the upward arcuous motion of the bulk bag pivoting conditioning assemblies in operation. This alleviates the significant downward forces associated with previous designs incorporating conditioners that contacted bulk bags in an opposing linear fashion.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 2:
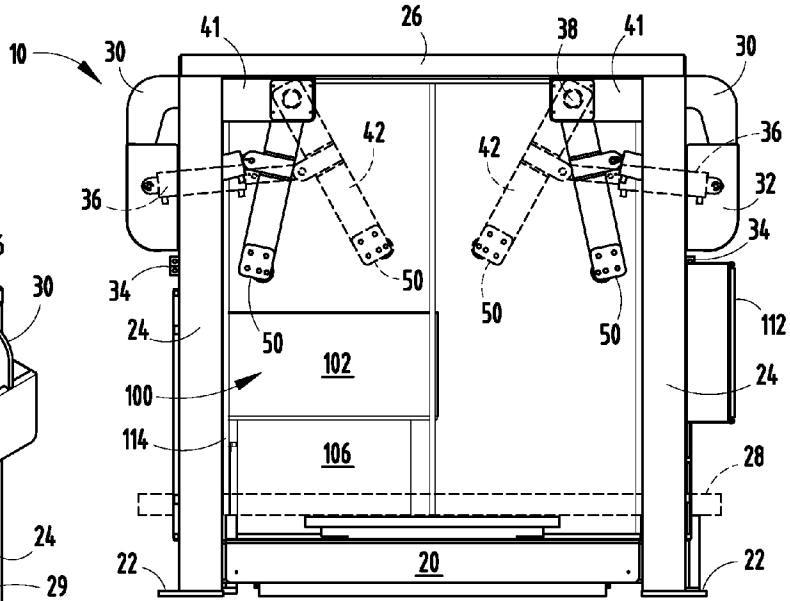
FIG. 2 is an elevated front view of an embodiment of the bulk bag material conditioner of the present invention.
Figure 2A:
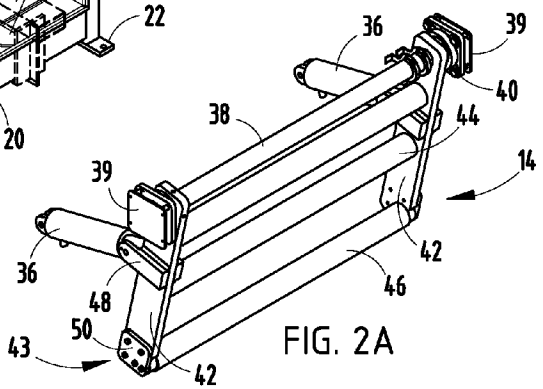
FIG. 2*a* is a portion of the bulk bag pivoting conditioning assembly including the hydraulic cylinders for actuating the frame.

According to an embodiment of the present invention, a bulk bag material conditioner 10 includes a main conditioner frame 12, two bulk bag pivoting conditioning assemblies 14, a safety system 16, a lift assembly 18, and a computer or other control mechanism for automating one or more of the various functions of the bulk bag material conditioner.

Figure 1:
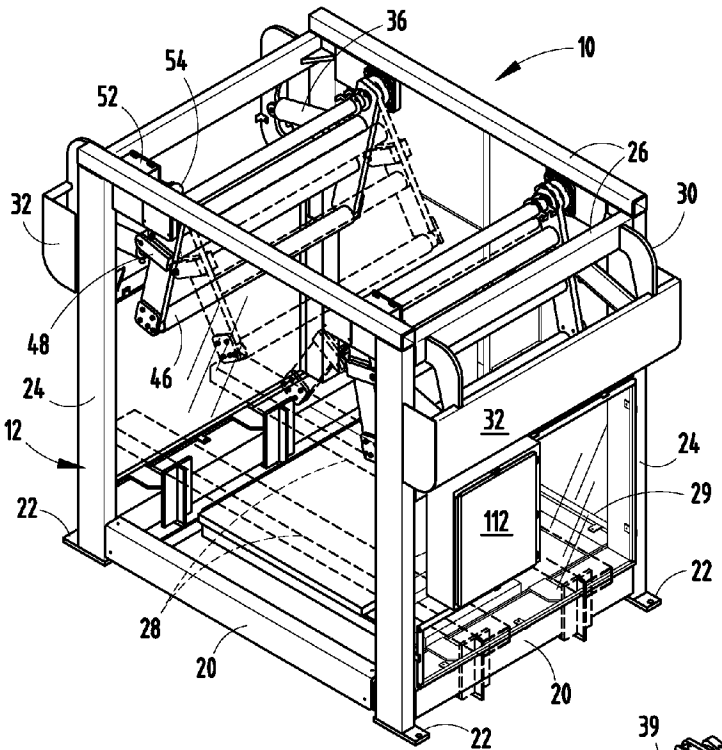
FIG. 1 is perspective view of an embodiment of the bulk bag material conditioner of the present invention.

The main conditioner frame 12 typically includes four base members 20 connected to another to form a substantially rectangular base formed by their engagement. Alternatively, the base members each engage two upwardly extending members 24 at the corner of the substantially rectangular base. If the base members connect to one another, the upwardly extending members may be affixed to the top surface of the base members. More typically, however, the base members engage the surface of the upwardly extending members as shown in FIGS. 1-2. Typically the upwardly extending members include feet 22 engaged to the bottom surface of upwardly extending members 24 that engage the factory or work surface floor. Each of the feet typically includes an aperture through which the feet, and thereby the entire bulk bag material conditioner, can be permanently or temporarily affixed to the surface of the factory or work surface. Additionally, interconnecting each of the upwardly extending members are cross supports 26. The main conditioner frame components are typically metal and engaged to one another via a weld or other similar engagement method. However, the component could conceivably be bolted to one another as well. The main conditioner frame 12 forms a substantially cubic or rectangular prism shaped structure. Additionally, the main conditioner frame may optionally include stationary or removable fork tubes/pockets 28 that operate to receive the tines of a forklift. When utilized, there are typically two such fork tubes/pockets incorporated in the typical bulk bag material conditioner.

The bulk bag material conditioner, according to an embodiment of the present invention, also typically includes bulk bag pivoting conditioning assemblies 14 engaged to the main conditioner frame 12. The bulk bag pivoting conditioning assemblies 14 typically include a conditioning arm mounting plate 41, generally U-shaped, typically planar, or substantially planar, hydraulic cylinder supports 30, a cylinder guard 32, one or more (hydraulic) manifolds 34, hydraulic cylinders 36, fixed shafts 38, shaft cover plates 39, four bolt flange bearings (two per arm) 40, a conditioner arm weldment 42, a removable shaft 46, a hydraulic cylinder engagement bracket member 48, and a shaft cap 50.

As shown in the various figures, the cylinder guard 32 bolts to the main frame assembly, which engages the opposing cross supports 26. Preferably, there are two hydraulic cylinder supports and two hydraulic cylinders in use, however, depending on the material being conditioned or the needs of a user one or a plurality of hydraulic cylinders and therefore a corresponding number of hydraulic cylinder supports may be utilized. The cylinders are sized depending upon the material being conditioned with larger cylinders used for more difficult/harder material to be conditioned and are typically pre-attached by the user based upon the material or range of material types to be conditioned. The cylinders typically have a 2-5 inch bore, more typically they have a four inch bore, and ten inch stroke.

The uppermost fixed shaft 38 on the bulk bag pivoting conditioning assemblies engage the two opposing conditioner arm weldments 42, which are themselves engaged to the conditioning arm mounting plate engaged to the cross supports of the main frame assembly. Typically this engagement further utilizes four (two per arm) bolt flange bearings for facilitating pivoting action about this pivot point when the hydraulic cylinders are activated. The hydraulic cylinders engage the hydraulic cylinder supports 30 and the hydraulic cylinder engagement bracket member 48, which is itself engaged to the conditioner arm weldment, typically by a weld. The bulk bag pivoting conditioning assemblies also typically include two additionally fixed shafts 44 spaced on opposite sides of the hydraulic cylinder engagement bracket member and a removable shaft positioned distal to the portion of the bulk bag pivoting conditioning assemblies that engage the main conditioner frame. Preferably, shaft caps 50 are engaged to the outside surface of the conditioner arm weldments at the distal end 43 of the conditioner arm weldments 42 as well. The shaft(s) that engage the bulk bag material are typically cylindrical, but could be shaped or constructed with added elements to differently contact the bulk bag. For example, the shaft might have a rectangular, square, triangular, oval, or star-shaped cross-section instead of a circular cross-section. Further examples include a non-linear shaft such as a wavy shaft and/or a shaft with a rounded paddle. Additionally, a shaft with a round and/or pointed attachment (s) engaged with the shaft could be used in any combination of the above cross-sections, shaft types and/or attachments could also be made.

The hydraulic system 100, which operates the hydraulics of the present invention, preferably uses a 10 horsepower and two (2) 5 GPM (gallons per minute) pumps (the motors and pumps may be differently sized depending upon the application). The system also uses a hydraulic reservoir 106 that also may be sized depending upon the application. A hydraulic mount is also typically used. Typically, the hydraulic system is a Parker® (or other brand) hydraulic pumping unit with the hydraulic reservoir 106, a fluid level sight gauge, an adjustable pressure relief valve, a system pressure gauge, a return line filtration system with spin on element, and twin submerge gear pumps. The hydraulic lines typically utilize stainless steel connectors. An enclosure cover 104 typically is used to cover access to the hydraulic system contained in the enclosure 102. Typically, the hydraulic and power lines within the bulk bag conditioning system include energy chain systems to protect the moving power and electrical connections. One such energy chain system is a nylon energy chain system. The systems operate to guide and protect the hoses, cord, and cables by preventing tangling, corkscrewing, premature wear, and material (dirt) contamination. The cords, cables, and/or hoses or other similar material are spaced within the energy chain system.

The bulk bag material conditioner of the present invention also may optionally include a safety system 16. When utilized, the safety system includes machine guards 29 preferably made out of clear plastic, metal, expanded metal, or other clear shock resistant or shatter proof material. Typically, the clear plastic machine guards are constructed of shatter-resistant or shatter-proof materials. Suitable materials may include flattened-expanded metal guarding, transparent polycarbonate guarding (with continually welded, carbon steel frames), transparent acrylic guarding (with continuously welded, (carbon) steel frames), metal guarding panels and combinations of over or more of the above. Typically, the machine guards are constructed such that they cover all or substantially all of any exposed accessible opening of appreciable size on the three non-loading sides of the bulk bag material conditioners of the present invention. Safety systems would not be necessary if a side was, for example, against a wall or other piece of machinery. Along the fourth side, the load side, there is typically a load side light curtain or other safety device that communicates with the control system such that when the light curtain is broken by any person or other object the bulk bag material conditioner stops. This insures the safety of the worker during operation. The light curtain is typically affixed to opposite sides of the upwardly extending member 24 on the front surface of the bulk bag conditioner. Other possible safety devices that may be used generally and typically on the load side include electrically interlocked doors containing a safety switch that stops operation of the device when the door is opened and through beam photoelectric sensors that similarly stop operations when the sensors are activated. These systems are also typical in communication with the control system of the bulk bag conditioning system.

Figure 12:
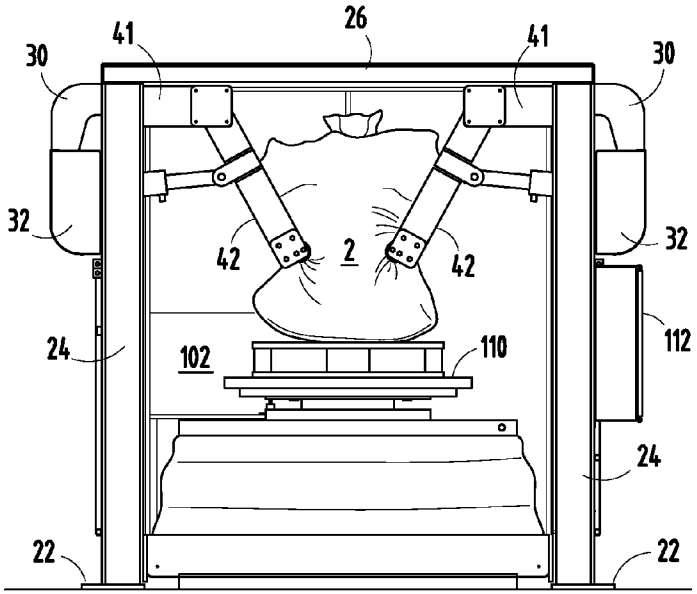
FIG. 12 is an elevated front view showing an embodiment of a material conditioner of the present invention.
Figure 15:
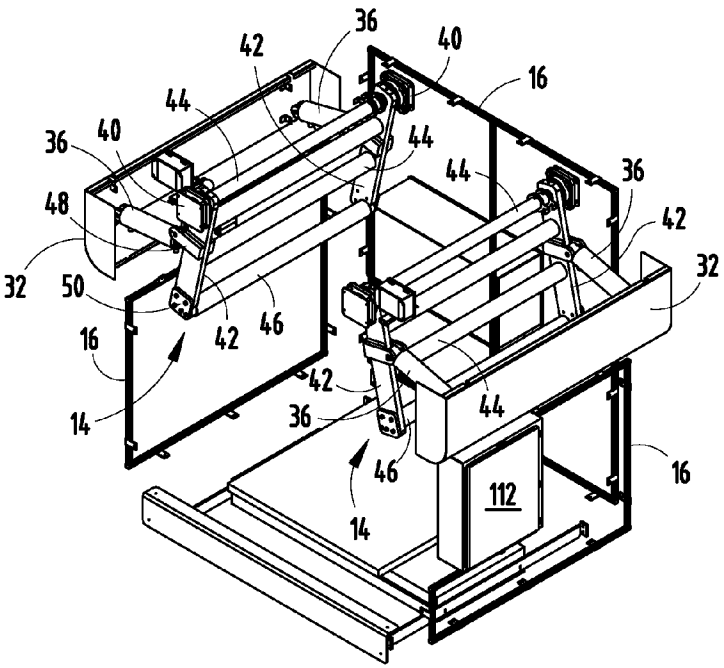
FIG. 15 is a perspective view of an embodiment of the present invention with the frame and optional fork tubes removed.
Figure 14:
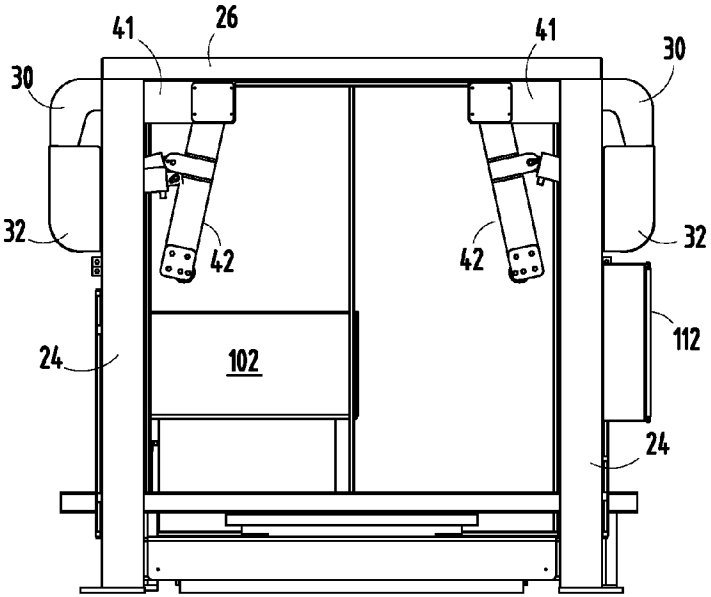
FIG. 14 is an elevated front view of an embodiment of the present invention.

Additionally, the bulk bag conditioner embodiment of the present invention further includes a lift assembly 18. The lift assembly typically includes a manual or powered rotary turntable 110 and a hydraulic powered lift system having two sets of opposing members engaged to opposite sides of a lift base and a center joint. The lift system hydraulics and elevating structures may be enclosed by a safety bellow (see FIG. 12), which is typically an accordion-style skirt that operates to prevent debris and materials (liquids and solids) from contacting the lift components. One or more hydraulic cylinders are connected to this assembly such that when the hydraulic cylinder is activated, the entire assembly forces the powered rotary turntable and the lift assembly tabletop surface to elevate as shown in FIGS. 3-4 and 7-9. The rotary turntable may be positioned on the top surface of the lift assembly and optionally affixed thereto the deck cover.

While the presently preferred embodiment incorporates the above-described lift assembly to elevate and lower and otherwise position the bulk bag in the appropriate vertical position for material conditioning, Applicants presently believe that the bag may be held at one height and the bulk bag conditioner assemblies mounted in a vertically movable track system such that the bulk bag contacting container assemblies would be vertically adjustable to contact different surfaces along the height of the bulk bag. This configuration however does not readily allow the bulk bag to be rotated. However, Applicants presently believe that it may be possible to keep the bulk bag on a powered rotary turntable that is placed and/or engaged to a stationary surface. In another alternative, the bulk bag could be hoisted or lifted to different positions using a hoist system such as the system described in U.S. Pat. No. 7,223,058, the disclosure of which is hereby incorporated by reference in its entirety. The hoist and material container transport assembly could operate to change the height of the bulk bag as discussed herein as an alternative to the lift assembly.

Figure 8:
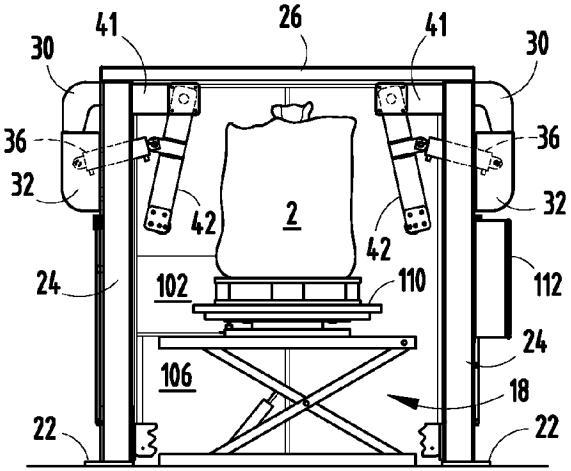
FIGS. 7-9 demonstrate contacting a portion of the bulk bag (FIG. 7) moving to the disengaged position (FIG. 8) and subsequently elevating the lift assembly to position the bulk bag at a different height and showing the bulk bag pivoting conditioning assemblies actuated and contacting the bulk bag at a different location at this new height (FIG. 9).
Figure 7:
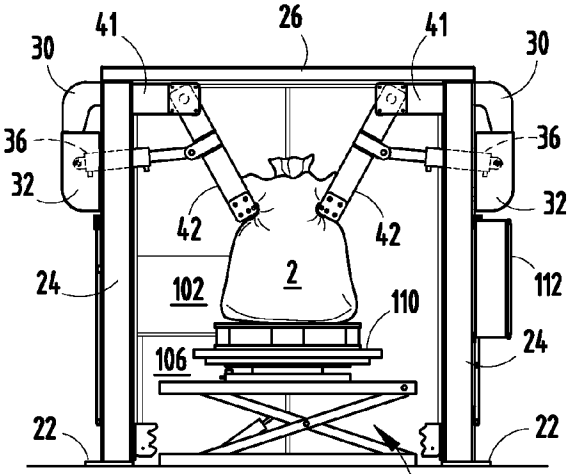
Figure 9:
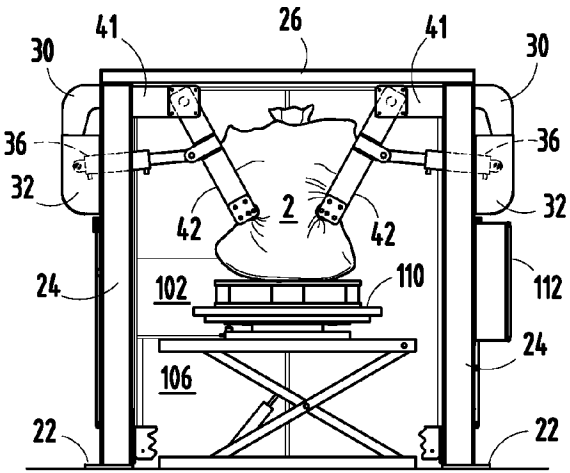
Figure 11:
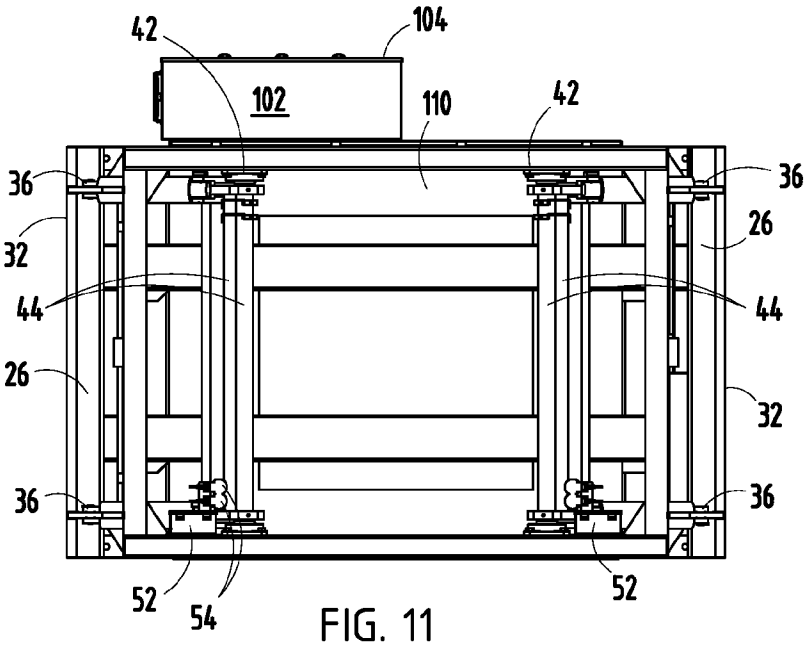
FIG. 11 is a top view of an embodiment of the present invention.
Figure 10:
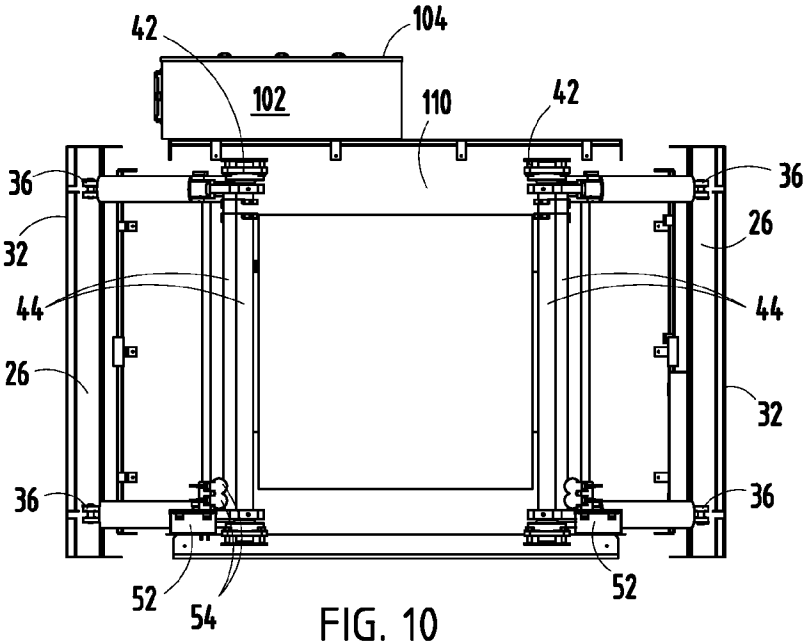
FIG. 10 is a top view of an embodiment of the present invention with the frame and fork tubes removed.
Figure 13:
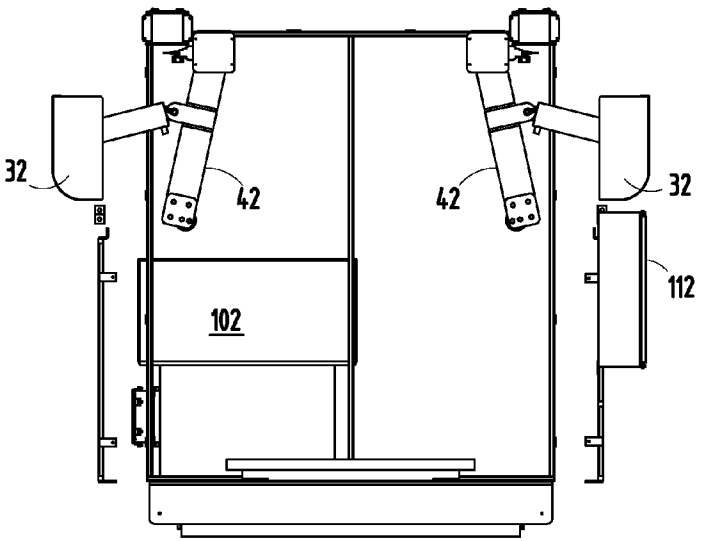
FIG. 13 is an elevated front view of an embodiment of the present invention with the frame and optional fork tubes removed.

In the typical operation, as shown in FIGS. 7-9, the control system is contained in the control enclosure 112. When a computer system is utilized, the computer system includes a processor, a memory subsystem coupled to the processor where the memory subsystem stores code that when executed causes the processor to perform one or more of the steps described herein for conditioning a bulk bag. Multiple different sets of commands may be provided by the code to allow a user to execute various different bulk bag conditioning steps utilizing the bulk bag conditioners of the present invention. User input can be received from a touch screen display, push button control interface, or other user input device such as a display and keyboard and keyboard and mouse.

Figure 4:
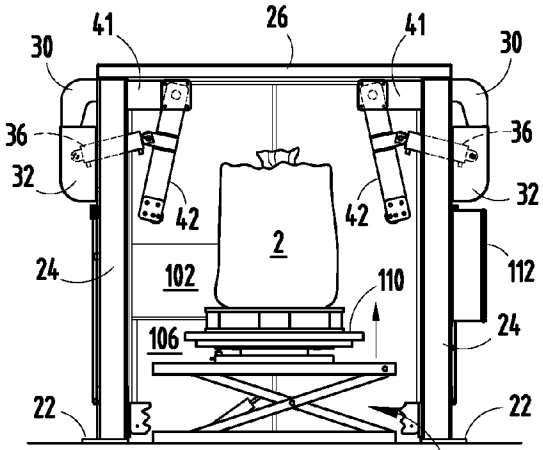
FIGS. 3-4 are elevated front views of a portion of an assembly according to the present invention showing use of the lift assembly to position the bulk bag at various heights.
Figure 3:
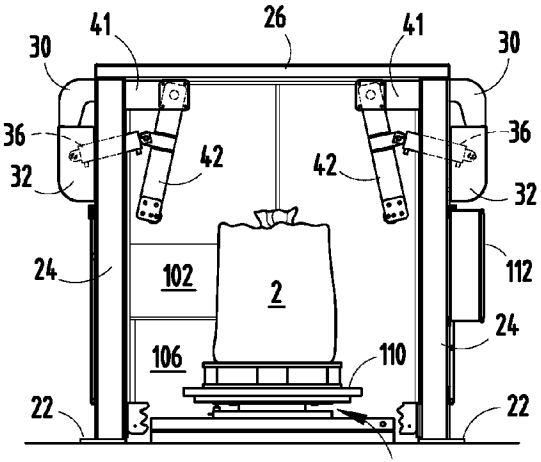
Figure 6:
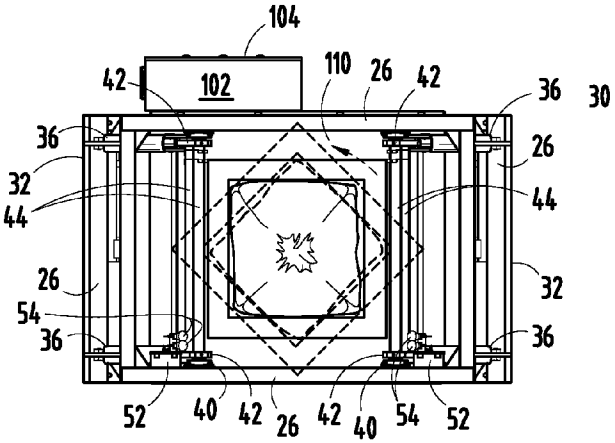
FIGS. 5-6 demonstrate the rotation of the bulk bag on the rotary turntable of the lift assembly.
Figure 5:
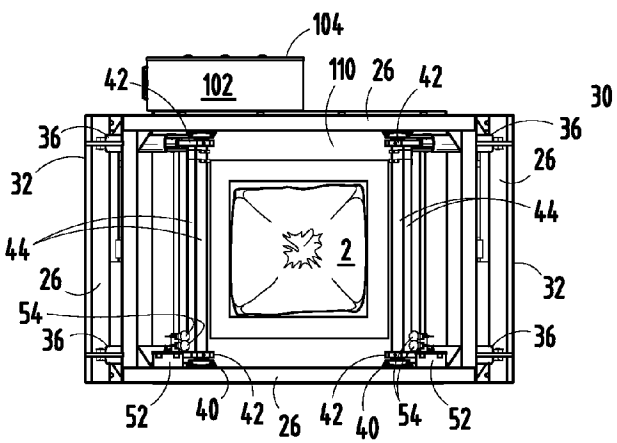

In typical operation a bulk bag, which may or may not be but typically is already placed on a pallet, is positioned on the powered rotary turntable 110 on the top surface of the hydraulic lift system. Typically the hydraulic lift system is capable of lifting the bulk bag at least approximately 48 inches. FIG. 3 shows the bulk bag on a pallet in the initially placed position. FIG. 4 shows the bulk bag being elevated to an initial conditioning position. As shown in FIGS. 5-6, the powered rotary turntable allows a user, via automatic or manual controls, to rotate the material bulk bag to when the bulk bag pivoting conditioning assemblies are in the disengaged position. Conceivably, although presently not preferred, the bulk bag material conditioners of the present invention may be linked to a network and controlled remotely by the user or other computer system or remotely by a user using another computer system that is in communication with the computer system that controls the material conditioner and optionally another machine such as a discharger.

The rotation allows the bulk bag pivoting conditioning assemblies to engage opposing sides of the bulk bag at an infinite number of angles to facilitate thorough material conditioning. Usually, as discussed above, the bulk bag is rotated 90° such that the conditioning assemblies engage opposite sides of the bulk bag 2. However, for example, the bulk bag 2 may be rotated 45° on two separate occasions and the bulk bag pivoting conditioning assemblies activated to engage and condition the bag at multiple locations along the bag. As will be appreciated, this could conceivably happen at any position in the 360° circle of rotation possibly used by powered rotary turntable 110. Of course, while not preferred, the rotary turntable could conceivably be manually driven. FIG. 7 shows the bulk bag pivoting conditioning assemblies engaging the bulk bag 2 at a first point on the height of the bag. While the bulk bag pivoting conditioning assemblies 14 are in operation, proximity sensors 54 communicate with the control device to control the travel distance of the bulk bag pivoting conditioning assemblies. The bulk bag material conditioners also typically include hydraulic pressure sensors that also preferably communicate with the control system. In this manner, the hydraulic pressure sensor and the proximity switches allow customization of the amount of pressure being applied to the material. Harder materials requiring greater force and more delicate materials typically requiring less force. Typically, the bulk bag conditioner assemblies 14 can be fully extended in about 12 seconds and fully retracted in about 8 seconds.

As shown in FIG. 8, once the bulk bag pivoting conditioning assemblies are disengaged the bulk bag can be elevated using the hydraulic lift assembly 18 and the conditioner assemblies 14 again activated to condition a different portion of the bag. As can be seen in FIG. 2, the conditioner assemblies 14 travel a non-linear, typically a curvilinear path. In this embodiment, when the conditioner assemblies travel in the generally upward curvilinear path, the conditioner assemblies apply an inward and upward force to the side of the bulk bag 2. This results in very little downward pressure being applied to the system, which reduces strain on the surface holding the material and lessens the chance that the bag will be damaged or that the bulk bag conditioning system itself will be damaged.

Figure 17:
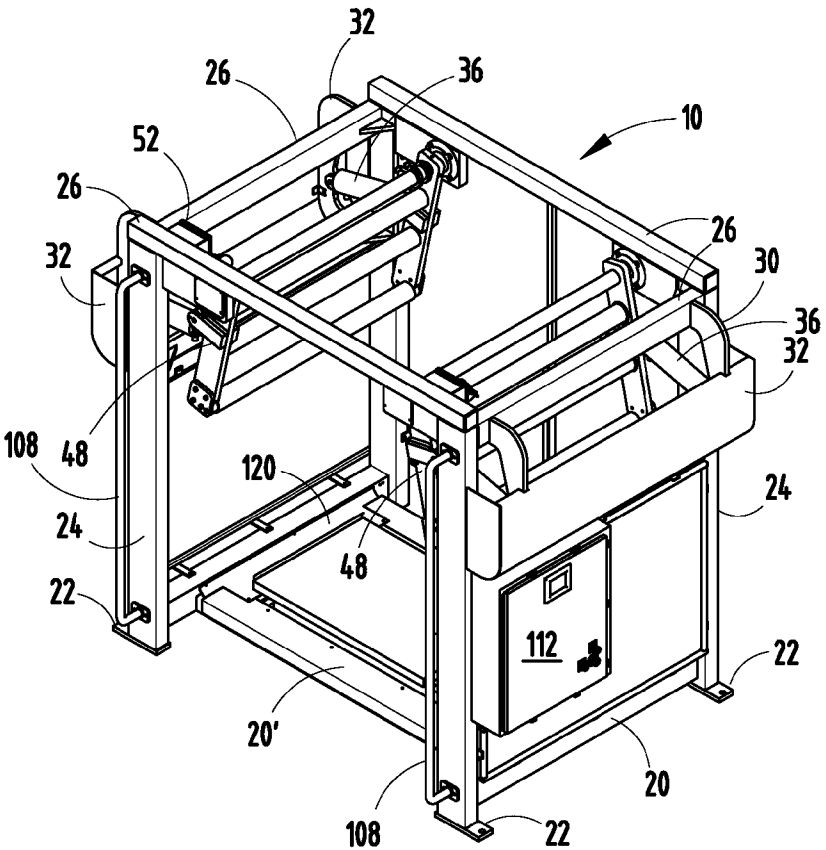
FIG. 17 is a perspective view of another embodiment of the present invention.
Figure 16:
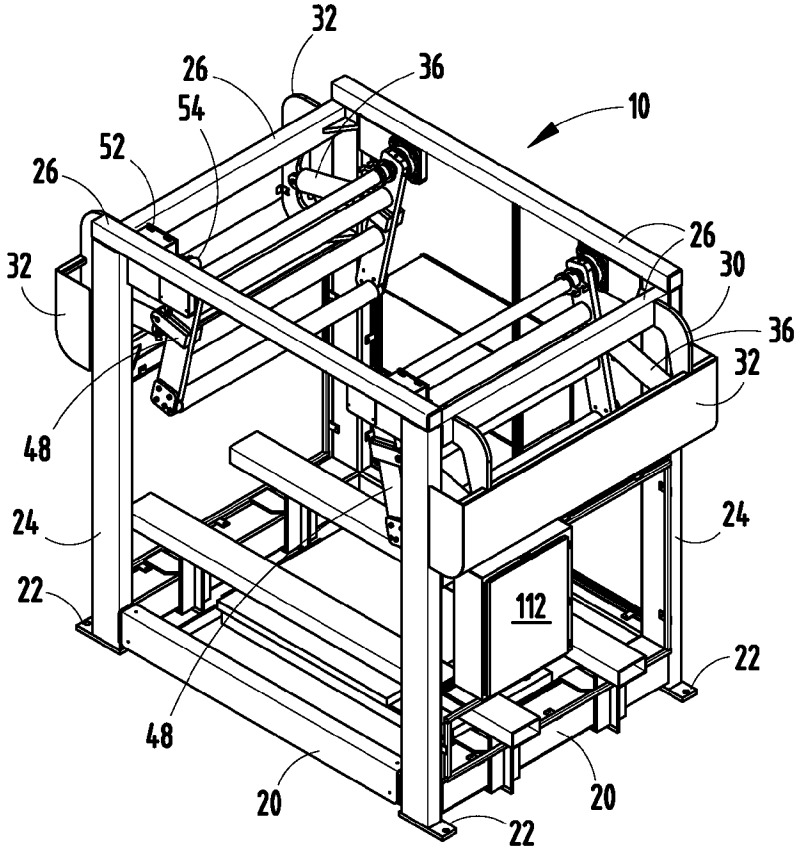
FIG. 16 is a perspective view of an embodiment of the present invention.

An alternative embodiment of the present invention is shown in FIG. 17. FIG. 17 shows the addition of typically steel generally U-shaped bars 108 and an alternative base frame of base members 20 shown as 20', which engage bracket members 120 in a tongue and groove manner to form a more tightly compact base framework in the shape of a square around the base of the lift assembly and positioned to prevent or substantially prevent movement, especially rotational movement of the lift assembly.

Finally, the bulk bag material conditioners of the present invention may be utilized alone or in combination or integrated within a bulk bag discharging system such as those systems disclosed in U.S. Pat. No. 7,223,058, the disclosure of which is hereby incorporated by reference in its entirety.

Therefore, it is to be understood that the embodiment shown in the drawings and described above is provided principally for illustrative purposes and should not be used to limit the scope of the invention. Furthermore, it is to be understood that such concepts are intended to be covered by the following claims unless these claims by their language expressly state otherwise.

The invention claimed is:

1. A bulk bag conditioning system comprising a main conditioner frame assembly comprising:

a base;

a plurality of upwardly extending support members with a base engaging end that engages a portion of the base and a distal end portion; and at least one cross support member engaged to the upwardly extending support members and wherein the base and the upwardly extending support members define a conditioning area having a load side, a side opposite the load side, and a first side second side opposite one another and between the load side and the side opposite the load side and wherein the main conditioner assembly is capable of receiving a bulk bag of material;

a first bulk bag pivoting conditioning assembly operatively engaged to the first side of the main conditioner frame assembly wherein the first bulk bag pivoting conditioning assembly moves about a first axis;

a second bulk bag pivoting conditioning assembly operatively engaged to the second side of the main conditioner frame assembly wherein the second bulk bag pivoting conditioning assembly moves about a second axis;

wherein the first bulk bag conditioning assembly and the second bulk bag pivoting conditioning assembly are positioned opposite or substantially opposite of one another; and at least two actuators that are moveable between a first and a second position wherein at least one actuator is operatively connected to each bulk bag pivoting conditioning assembly and the main conditioner frame such that first and second bulk bag pivoting conditioning assemblies travel a non-linear path between an initial position to a bulk bag contacting position;

wherein the first and second bulk bag conditioning assemblies further comprise a plurality of cylindrical shafts each having a length; wherein at least one of which contacts a bulk bag along the length of the cylindrical shaft when the bulk bag conditioning assemblies are in the bulk bag contacting position wherein the main conditioner frame assembly comprises at least four upwardly extending members and at least four cross support members each having two ends where each end of each cross support member engages the distal end portion of one of the upwardly extending support members and each upwardly extending support member engages at least two cross support members; and wherein the bulk bag conditioning system further comprises at least four elongated and substantially planar bulk bag conditioning assembly mounting supports each having an outer surface and a conditioning area facing surface opposite the outer surface; and wherein the substantially planar bulk bag conditioning assembly mounting supports engage the cross supports of the main conditioner frame assembly and the distal ends of the upwardly extending support members of the main conditioner frame assembly; and wherein the first and second bulk bag conditioning assemblies each further comprise at least two opposing, elongated conditioner arms each having a main conditioner frame engagement end that includes an aperture and a distal end; and wherein the cylindrical shafts of the bulk bag conditioning assemblies are spaced between the conditioner arms and at least one cylindrical shaft is positioned between the distal ends of the two conditioner arms and at least one cylindrical shaft is positioned between the two conditioner arms at the main conditioner frame engagement end and through the apertures such that the ends of the cylinder shaft engage the conditioning area facing surface of the substantially planar bulk bag conditioning assembly mounting supports and the cylindrical shaft positioned between the two conditioner arms at the main conditioner frame engagement end that engages the conditioning area facing surface of the substantially planar bulk bag conditioning assembly mounting supports defines an axis that intersects two of the substantially planar bulk bag conditioning assembly mounting supports and is one axis about which the bulk bag conditioning assembly rotates;

wherein the system further comprises cylinder shaft engaging bearing components that are engaged with the bulk bag conditioning assembly facing surface of the supports and; receive an end of the cylinder shaft while retaining the shaft in position and allowing rotational movement of the shaft wherein:

the system further comprises a shaft cap engaged to the outer surface of the substantially planar bulk bag conditioning assembly mounting supports and the cylinder shaft engaging plates and wherein the cylinder shaft engaged with the bearing components defines a fixed axis about which the bulk bag conditioning assembly rotates and all other cylinder shafts travel an arcuous path when the bulk bag conditioning assemblies are actuated.

2. The bulk bag conditioning system of claim 1, wherein at least one cross support member is engaged to the distal end portions of the upwardly extending support members and wherein the main conditioner frame assembly forms at least substantially cubic or at least substantially rectangular prism shaped structure; and the first and second bulk bag conditioning assemblies each pivot about an axis such that the forces contacting the bag when the assemblies are in the bulk bag contacting position are not directly opposing one another and such that the assemblies follow a generally arcuous path.

3. The bulk bag conditioning system of claim 2, wherein the main conditioner frame assembly further comprises at least one pair of fork tubes engaged to the portion of the main conditioner frame assembly; and the assemblies follow a generally upwardly arcuous path between the initial position and the bulk bag contacting position.

4. The bulk bag conditioning system of claim 1, wherein the substantially planar bulk bag conditioning assembly mounting supports are integral with the upwardly extending members, at least one of the cross support members, or both one cross support member and an upwardly extending member; and wherein the cross support members form a generally rectangular shape.

5. A bulk bag conditioning system comprising a main conditioner frame assembly comprising:

a base;

a plurality of upwardly extending support members with a base engaging end that engages a portion of the base and a distal end portion; and at least one cross support member engaged to the upwardly extending support members and wherein the base and the upwardly extending support members define a conditioning area having a load side, a side opposite the load side, and a first side second side opposite one another and between the load side and the side opposite the load side and wherein the main conditioner assembly is capable of receiving a bulk bag of material;

a first bulk bag pivoting conditioning assembly operatively engaged to the first side of the main conditioner frame assembly wherein the first bulk bag pivoting conditioning assembly moves about a first axis;

a second bulk bag pivoting conditioning assembly operatively engaged to the second side of the main conditioner frame assembly wherein the second bulk bag pivoting conditioning assembly moves about a second axis;

wherein the first bulk bag conditioning assembly and the second bulk bag pivoting conditioning assembly are positioned opposite or substantially opposite of one another; and at least two actuators that are moveable between a first and a second position wherein at least one actuator is operatively connected to each bulk bag pivoting conditioning assembly and the main conditioner frame such that first and second bulk bag pivoting conditioning assemblies travel a non-linear path between an initial position to a bulk bag contacting position wherein the first and second bulk bag conditioning assemblies further comprise a plurality of elongated shafts each having a length wherein at least one of the shafts contacts a bulk bag along the length of the shaft when the bulk bag conditioning assemblies are in the bulk bag contacting position; and wherein the main conditioner frame assembly forms a substantially cubic, a cubic, a substantially rectangular prism shaped, or a rectangular prism shaped structure having four upper corners and having a load side and a side opposite the load side, left side, and right side opposite one another and wherein the left side and the right side are between the load side and the side opposite the load side; and wherein the bulk bag conditioning system further comprises at least four elongated and substantially planar bulk bag conditioning assembly mounting supports each having an outer surface and a conditioning area facing surface opposite the outer surface; and wherein the planar bulk bag conditioning assembly mounting supports engage the cross supports of the main conditioner frame assembly and the distal ends of the upwardly extending support members of the main conditioner frame assembly at the upper corners such that the conditioning area facing surface of the support surface of one support faces the conditioning area facing surface of the support surface of one other support; and wherein the first and second bulk bag conditioning assemblies each further comprise at least two opposing, elongated conditioner arms each having a main conditioner frame engagement end having an aperture and a distal end; and wherein the elongated shafts of the bulk bag conditioning assemblies are spaced between the conditioner arms and at least one shaft is positioned between the distal ends of the two conditioner arms and at least one shaft is positioned between the two conditioner arms at the main conditioner frame engagement end and through the aperture of the main conditioner frame engaging end; and wherein the system further comprises shaft engaging bearings that are engaged to the conditioning area facing surface of the supports and also engage an end of the shaft while retaining the shaft in position and allowing rotational movement of the shaft;

wherein the system further comprises a shaft cap engaged to the outer surface of the substantially planar bulk bag conditioning assembly mounting supports; and wherein the shaft engaged with the bearings defines a fixed axis about which the bulk bag conditioning assembly rotates and all other elongated shafts travel an arcuous path when the bulk bag conditioning assemblies are actuated.

6. The bulk bag conditioning system of claim 5, wherein the main conditioner frame assembly of the bulk bag conditioner system further comprises at least one actuator support member engaged with the main conditioner frame assembly and positioned parallel to and between two of the upwardly extending support members on each of the left side and the right side; and wherein at least one actuator is operatively connected to the actuator support member on each side and the opposite end of the actuator is operatively connected to the bulk bag conditioning assembly.

7. The bulk bag conditioning system of claim 5, wherein the main conditioner frame assembly of the bulk bag conditioner system further comprises at least one actuator support member positioned between two of the upwardly extending support members above the midpoint of the upwardly extending support members; and wherein the system comprises at least two actuators operatively connected to the actuator support member on both the left and right sides of the main conditioner frame assembly and the opposite end of one of the actuators engages the elongated conditioning arm on each side of the bulk bag conditioning assemblies.

8. The bulk bag conditioning system of claim 7, wherein each actuator engages the elongated conditioning arms of the bulk bag conditioning assemblies using an actuator engagement bracket; and wherein the actuators are hydraulic cylinders; and wherein the shortest distance from the exterior of the conditioning area to the point where the hydraulic cylinder is engaged with the actuator support member is less than the stroke length of the hydraulic cylinder.

9. The bulk bag conditioning system of claim 5, wherein the bulk bag conditioning system further comprises a hydraulic lift system having a lower portion and an upper deck portion wherein the lift assembly is capable of lifting and rotating a bulk bag of material and the lift assembly further comprises an accordion-style covering over the lower portion of the lift assembly.

10. The bulk bag conditioning system of claim 1, wherein the bulk bag conditioning system further comprises a lift system capable of lifting and rotating the bulk bag of material when the bulk bag of material is positioned within the conditioning area.

11. The bulk bag conditioning system of claim 10, wherein the lift system comprises a hydraulic lift system positioned within the framework of the main conditioner frame assembly and the lift system automatically rotates and elevates the bulk bag of material based at least in part upon input from an operator received prior to or during use of the bulk bag conditioning system.

12. The bulk bag conditioning system of claim 10, wherein the lift system further comprises a rotary turntable positioned on a top surface of the lift assembly and the bulk bag conditioning system further comprises a computer control system operatively connected to the lift system and the bulk bag conditioning assemblies wherein the computer control system comprises a processor, a memory subsystem coupled to the processor where the memory subsystem stores code that, when executed based upon input received from the user, one or more steps for conditioning a bulk bag of material are performed; and wherein the one or more steps comprise one or more steps chosen from the group consisting of elevating the lift system to one or more user determined height, rotating the rotary turntable, lowering the lift system to one or more user determined height, and actuating the bulk bag conditioning assemblies.

13. The bulk bag conditioning system of claim 10, wherein the bulk bag conditioning system further comprises a safety system on at least the load side of the main conditioner frame assembly that operates to stop actuation of the bulk bag conditioning assemblies wherein the safety system comprises a safety system chosen from the group consisting of a light curtain, interlocked doors, and through beam photoelectric sensors.

14. A bulk bag conditioning system comprising: a main conditioner frame assembly comprising:

a base portion comprising four elongated members arranged in a rectangular configuration wherein opposing elongated members of the base have at least substantially the same length and wherein the four elongated members are in substantially the same plane and parallel to a floor;

at least four upwardly extending support members that extend upward from the base portion and have a base engaging end that is engaged to the base portion and a distal end portion; at least four cross support members engaged to the distal end portions of the upwardly extending support members and forming four corner sections and wherein the upwardly extending support members and the cross members define a conditioning area having a load side, a side opposite the load side, and a first side and a second side opposite one another and between the load side and the side opposite the load side and the conditioning area is capable of receiving a bulk bag of material;

wherein at least the plane defined by the base members and the upwardly extending support members and the cross support members define a substantially rectangular prism shaped structure or a rectangular prism shaped structure;

wherein the main conditioner frame assembly comprises at least two substantially planar or planar bulk bag conditioning assembly support members having an interior surface that are engaged to a load side cross member proximate two of the corners and at least two substantially planar or planar bulk bag conditioning assembly support members having an interior surface that are engaged to the cross member proximate the side opposite the load side proximate two of the corners such that the bulk bag conditioning assembly support members form two pair of support members that face one another;

at least two generally U-shaped actuating cylinder engagement brackets vertically engaged with the cross support member that extends along the first side of the main conditioner frame assembly and between the distal end portions of the upwardly extending members and a secondary support member positioned below the cross support member that extends along the first side and interconnecting the upwardly extending members along the first side of the main conditioner frame assembly at or above the midpoint of the upwardly extending members and wherein the generally U-shaped brackets are positioned proximate the corner sections of the main conditioner frame assembly along the first side; and at least two generally U-shaped actuating cylinder engagement brackets vertically engaged with the cross support member that extends along the second side of the main conditioner frame assembly and between the distal end portions of the upwardly extending members and a secondary support member positioned below the cross support member that extends along the second side and interconnecting the upwardly extending members along the second side of the main conditioner frame assembly at or above the midpoint of the upwardly extending members and wherein the generally U-shaped bracket is positioned proximate the corner sections of the main conditioner frame assembly along the second side;

a first bulk bag pivoting conditioning assembly engaged with the first side of the main conditioner frame assembly comprising:

a first elongated conditioner arm and a second elongated conditioner arm wherein each elongated conditioner arm has a main conditioner frame assembly engaging end having an aperture for receiving a shaft and a distal end; at least one bulk bag engaging shaft engaged proximate the distal end of the first and second elongated conditioner arms that engages a bulk bag of material and a rotatable, stationary shaft engaged with the main conditioner frame assembly engaging end of the elongated conditioner arms through the apertures thereby defining a second axis of rotation and wherein the ends of the rotatable, stationary shaft each engage a flange bearing assembly that is engaged to the interior surface of the support members proximate the first side of the main conditioner frame assembly; and a first actuating cylinder and a second actuating cylinder each having a generally U-shaped actuating cylinder engagement bracket end wherein the first actuating cylinder is engaged to a first generally U-shaped actuating cylinder engagement brackets along the first side of the main conditioner frame assembly at the generally U-shaped actuating cylinder engagement bracket end and wherein the first actuating cylinder further includes a first bulk bag pivoting conditioning assembly engaging end that engages a portion of first elongated conditioner arm of the first bulk bag pivoting conditioning assembly between the distal end and the main conditioner frame assembly engaging end of the first elongated conditioner arm and wherein the second actuating cylinder is engaged to one of the generally U-shaped actuating cylinder engagement brackets along the first side of the main conditioner frame assembly at the generally U-shaped actuating cylinder engagement bracket end and the second actuating cylinder further includes a first bulk bag pivoting conditioning assembly engaging end that engages a portion of the second elongated conditioner arm of the first bulk bag pivoting conditioning assembly between the distal end and the main conditioner frame assembly engaging end of the second elongated conditioner arm such that the first bulk bag pivoting conditioning assembly rotates between a first position and a second position about the first axis of rotation defined by the rotatable, stationary shaft when the actuating cylinders are activated and wherein the second position is higher than the first position relative to the base portion;

a second bulk bag pivoting conditioning assembly engaged with the second side of the main conditioner frame assembly comprising:

a first elongated conditioner arm and a second elongated conditioner arm wherein each elongated conditioner arm has a main conditioner frame assembly engaging end having an aperture for receiving a shaft and a distal end;

at least one bulk bag engaging shaft engaged proximate the distal end of the first and second elongated conditioner aims that engages a bulk bag of material and a rotatable, stationary shaft engaged with the main conditioner frame assembly engaging end of the elongated conditioner arms through the apertures thereby defining a second axis of rotation and wherein the ends of the rotatable, stationary shaft each engage a flange bearing assembly that is engaged to the interior surface of the support members proximate the second side of the main conditioner frame assembly; and a first actuating cylinder and a second actuating cylinder each having a generally U-shaped actuating cylinder engagement bracket end wherein the first actuating cylinder is engaged to a first generally U-shaped actuating cylinder engagement brackets along the second side of the main conditioner frame assembly at the generally U-shaped actuating cylinder engagement bracket end and wherein the first actuating cylinder further includes a second bulk bag pivoting conditioning assembly engaging end that engages a portion of first elongated conditioner arm of the second bulk bag pivoting conditioning assembly between the distal end and the main conditioner frame assembly engaging end of the first elongated conditioner arm and wherein the second actuating cylinder is engaged to one of the generally U-shaped actuating cylinder engagement brackets along the second side of the main conditioner frame assembly at the generally U-shaped actuating cylinder engagement bracket end and the first actuating cylinder further includes a second bulk bag pivoting conditioning assembly engaging end that engages a portion of the second elongated conditioner arm of the second bulk bag pivoting conditioning assembly between the distal end and the main conditioner frame assembly engaging end of the second elongated conditioner arm such that the second bulk bag pivoting conditioning assembly rotates between a first position and a second position about the second axis of rotation defined by the rotatable, stationary shaft when the actuating cylinders are activated and wherein the second position is higher than the first position relative to the base portion; and a lift assembly capable of moving up and down between multiple positions and having a bulk bag receiving surface that is rotatable.

15. A method of conditioning material within a bulk bag that has become hardened, caked, solidified, or agglomerated to form a flowable material comprising the following steps:

providing a bulk bag conditioning system comprising a main conditioner frame assembly comprising:

a base portion;

a plurality of upwardly extending support members with a base engaging end that is engaged to the base and a distal end portion;

plurality of cross support members engaged to the distal end portions of the upwardly extending support members and wherein the base and the upwardly extending support members define a conditioning area having a load side, a side opposite the load side, a first side and a second side opposite one another and between the load side and the side opposite the load side and wherein the main conditioner assembly is capable of receiving a bulk bag of material;

a first bulk bag pivoting conditioning assembly operatively engaged to the first side of the main conditioner frame assembly wherein the first bulk bag pivoting conditioning assembly comprises a bulk bag engaging shaft and moves about a first axis from a first position to a second position wherein the second position is higher than the first position relative to the base portion;

a second bulk bag pivoting conditioning assembly operatively engaged to the second side of the main conditioner frame assembly wherein the second bulk bag pivoting conditioning assembly comprises a bulk bag engaging shaft and moves about a second axis from a first position to a second position wherein the second position is higher than the first position relative to the base portion; wherein the first bulk bag conditioning assembly and the second bulk bag pivoting conditioning assembly are positioned opposite or substantially opposite of one another; and at least two actuators that are moveable between a first and a second position wherein at least one actuator is operatively connected to each bulk bag pivoting conditioning assembly and the main conditioner frame such that first and second bulk bag pivoting conditioning assembly travel a curvilinear path between a first position and a second position; and a lift assembly with a rotatable turntable;

loading a bulk bag of material containing material that has become hardened, caked, solidified, or agglomerated onto the rotatable turntable of the lift assembly;

activating the lift assembly so that the bulk bag of material moves to a first position at a first user defined height;

moving the actuators associated with both the first and second bulk bag conditioning assemblies such that the bulk bag engaging shaft of the first bulk bag conditioning assembly and the bulk bag engaging shaft of the second bulk bag conditioning assembly engage opposite sides of the bulk bag of material at a first height along the side of the bulk bag of material;

moving the actuators associated with both the first and second bulk bag conditioning assemblies such that the bulk bag engaging shaft of the first bulk bag conditioning assembly and the bulk bag engaging shaft of the second bulk bag conditioning assembly disengage the bulk bag of material;

optionally activating the rotary table to rotate the bulk bag of material such that the sides not already engaged by the bulk bag engaging shafts are positioned to be engaged by the bulk bag engaging shafts;

optionally moving the actuators associated with both the first and second bulk bag conditioning assemblies such that the bulk bag engaging shaft of the first bulk bag conditioning assembly and the bulk bag engaging shaft of the second bulk bag conditioning assembly engage opposite sides of the bulk bag of material that have not already been engaged at a first height along the side of the bulk bag of material and moving the actuators associated with both the first and second bulk bag conditioning assemblies such that the bulk bag engaging shaft of the first bulk bag conditioning assembly and the bulk bag engaging shaft of the second bulk bag conditioning assembly disengage the bulk bag of material;

optionally activating the lift assembly to position the bulk bag of material at a second position at a second user defined height and moving the actuators associated with both the first and second bulk bag conditioning assemblies such that the bulk bag engaging shaft of the first bulk bag conditioning assembly and the bulk bag engaging shaft of the second bulk bag conditioning assembly engage opposite sides of the bulk bag of material at a second height along the side of the bulk bag of material and moving the actuators associated with both the first and second bulk bag conditioning assemblies such that the bulk bag engaging shaft of the first bulk bag conditioning assembly and the bulk bag engaging shaft of the second bulk bag conditioning assembly disengage the bulk bag of material;

returning the lift assembly to an unloading position; and removing the conditioned bulk bag containing material in a flowable form from the bulk bag conditioning system.

* * * * *